US006583360B1

(12) United States Patent
Yudashkin

(10) Patent No.: US 6,583,360 B1
(45) Date of Patent: Jun. 24, 2003

(54) COAXIAL AUDIO CABLE ASSEMBLY

(76) Inventor: Igor Yudashkin, 1412 NW. 179th Ave., Pembroke Pines, FL (US) 33029

( * ) Notice: Subject to any disclaimer, the term of this patent is extended or adjusted under 35 U.S.C. 154(b) by 0 days.

(21) Appl. No.: 10/071,582

(22) Filed: Feb. 8, 2002

(51) Int. Cl.[7] ..... H01B 7/34
(52) U.S. Cl. ..... 174/105 R
(58) Field of Search ..... 174/28, 103, 104, 174/105 R, 106 R, 108, 117 F; 333/243

(56) References Cited

U.S. PATENT DOCUMENTS 466,268 A * 12/1891 Conner et al. ..... 174/105 R
1,781,092 A 11/1930 Affel et al.
1,946,190 A * 2/1934 Brodhun ..... 174/105 R
2,342,736 A 2/1944 Herzog et al.
2,436,421 A 2/1948 Cork
3,351,706 A 11/1967 Cnerre et al.
3,541,221 A * 11/1970 Aupoix et al. ..... 174/105 R
4,376,920 A * 3/1983 Smith ..... 174/105 R
4,779,264 A * 10/1988 Glover ..... 340/310.01
4,847,448 A * 7/1989 Sato ..... 174/103
5,230,033 A * 7/1993 Soodak ..... 174/108
5,298,682 A * 3/1994 Salz ..... 174/105 R
5,696,831 A * 12/1997 Inanaga et al. ..... 381/309

* cited by examiner

*Primary Examiner*—Chau N. Nguyen

(57) ABSTRACT

A coaxial audio cable of the invention is design to separate audio signal into high and low pitch, e.g., for BASS and TREBLE. This is achieved by using two or more different AWG conductors for inner and outer conductive layers. The inner and outer layers of conductors may have different number of wires and are twisted at different angles to match specific operation conditions of the conductors that fulfill different functions. In addition to insulation layers made from Teflon or a similar plastic, the conductive layers that fulfill different functions can be shielded with a metal foil for additional protection against signal interference. The foil may be placed between the inner layer and the outer layer, and additionally over the outer layers, or only around the outer layer. The conductor wires are insulated from each other by being embedded and sealed in a cured insulating coating such as a curable resin. Another distinguishing feature of the cable of the invention is that the conductor wires are twisted with a relatively low angle, which for the inner layer is within the range from 0 to 18 degrees and for the outer layer is from 8 to 12 degrees. The invention also relates to a method for optimization of transmission of signals through different conductive layers of the cable for different parts of the frequency range of the electrical signals.

1 Claim, 4 Drawing Sheets

COAXIAL AUDIO CABLE ASSEMBLY

FIELD OF THE INVENTION

The present invention relates generally to coaxial cables and in particular to a coaxial cable assembly comprising single or dual coaxial cables with a plurality of spiral conductors wound one over the other through insulation layers. More specifically, the invention relates to a coaxial audio cable with layers of conductors differentiated with regard to frequencies of the audio signals to be transmitted.

BACKGROUND OF THE INVENTION

Normally, audio cables are intended for transmission of audio signals from an electrical signal source (e.g., a microphone) with an amplifier to a converter of electrical signals (known as a sound load or simply as a load) into sound or acoustic signals. It is understood that audio cables have to satisfy specific requirements dictated by their above-described function. More specifically, the audio cable should transmit the electrical signals in an optimal mode with minimal losses and distortions. This is especially important for acoustic instruments and apparatuses of high fidelity.

Although a human ear can sense the sounds in a limited range of acoustic frequencies, i.e., from several Hertz to about 16 KHz, the frequency range of the electrical signals to be transmitted to a load should significantly overlap the audible range. This is because, there exists an opinion that when higher frequencies are mixed in the load, they generate audible frequencies that impart to the reproduced sounds more natural "color" and enrich the reproduced sounds. Such systems are known as systems of authentic acoustical reproduction. Requirements to components of such systems, including audio cables, are especially stringent. For examples, the high-end amplifiers of modern high-fidelity sound systems may have an output frequency of up to 200 KHz.

Generally speaking, coaxial cables for use in a variety of purposes are well known since beginning of the last century. Main characteristics of the coaxial audio cable are parameters that determine the ability of the cable to transmit electrical signals without loss and distortion, e.g., from the electrical amplifier to a load. One important characteristic of the audio cable is impedance in all frequency ranges of the cable. Impedance is especially critical in the range of high and super-high frequencies. This characteristic is important because the load, e.g., a group of speakers connected in parallel and intended for reproduction of sounds in different frequency ranges, is essentially a reactive load. This means that for efficient matching of impedance of the cable with impedance of the load, the impedance inherent in the cable must be significantly lower than the impedance of the load in all frequency ranges. Furthermore, it is essential to minimize the loss of the electrical power of transmitted signals. Another problem that may occur in operation of audio cables is that on some frequencies a resonance may occur in a system "amplifier-cable-load". This condition may result from impedance of a low-quality cable.

In general, the knowledge of coaxial cables has been known for a long time. A few examples of such cables are described in U.S. Pat. No. 1,781,092 issued to Affel et al., U.S. Pat. No. 2,342,736 issued to Herzog et al., U.S. Pat. No. 2,436,421 issued to Cork, and U.S. Pat. No. 3,351,706 issued to Gnerre et al.

U.S. Pat. No. 1,781,092 to Affel discloses a conducting system for transmitting with small attenuation a band of frequencies. The conducting system employs a circuit having concentric conductors of relatively large diameter, one acting as return for the other. The inner conductor is formed by spirally winding a plurality of wires about a suitable core, thus forming in effect a hollow conducting shell. Dielectric spacing washers are mounted upon the inner shell to form a support for the outer conductor. The outer conductor is formed by spirally winding a plurality of wires over the outer surfaces of the supporting washers to form an outer conducting shell. A waterproof covering then surrounds the entire surface of the outer conductor to protect the system from moisture.

U.S. Pat. No. 2,342,736 to Herzog et al. discloses a wide-band radio cable of constant attenuation, which is suitable for distortion-free transmission up to a certain frequency value. The cable includes an internal conductor consisting of braded radio strands and is seated on a hemp-cord. The conductor is embedded in a plastic insulating compound. The outer conductor consists of braded radio strands and is mounted on the insulating compound surrounded with an insulating sheath.

U.S. Pat. No. 2,436,421 to Cork discloses the transmission of electrical energy by electric cables of the concentric line type. The cable includes an inner conductor of drawn copper wire, which is held centrally of a sheath of insulating material by a thread of the same material. The outer conductor consists of a braided sheath composed of strands of copper wire. The individual strands are insulated from each other by enameling or shellac. The outer protective covering of the cable consists of a sheath of polyethylene.

U.S. Pat. No. 3,351,706 to Gnerre et al. discloses a submarine coaxial cable consisting of a central metallic conductor embedded in a layer of dielectric material and with a braided conductor of wire strands located between an inner layer of solid dielectric and an outer layer of solid dielectric. Both conductors are copper or other highly conductive material and the dielectric layers are of a polyolefinic material.

The prior art fails to provide a coaxial cable having an inner and outer conductor having matching series impedances. By having matching series impedances, a superior signal can be transmitted by the cable. Such superior signal transmission is highly desirous for use with premium-quality sound systems.

The above problems are partially solved by U.S. Pat. No. 5,298,682 issued to D. Salz in 1994. This patent describes a coaxial cable that includes braided and coated, inner and outer conductors. The inner conductor is disposed along a hollow tubular core at a braid angle of approximately eighteen degrees. A dielectric layer composed of spiral-wrapped Teflon or microporous Teflon tape is wrapped around the inner conductor to insulate the inner conductor from the outer conductor. The outer conductor is disposed along the dielectric layer at a braid angle of approximately thirty-eight degrees. The number of strands in the inner and outer braids are chosen to provide a 5:6 ratio between the number of strands in the inner braid and the number of strands in the outer braid. A jacket insulates the outer conductor. The inner and outer conductors are configured according to a specific combination/formula of strand diameters, strand quantities, and braid angles in order that the conductors have optimized and matched, thus symmetrical, impedance for superior sound quality.

Although D. Salz introduced the conception of matching the series impedances between the respective inner and outer conductors as well as a specific ratio between the numbers of strand groups in inner and outer conductors, he does not differentiate between the audio signals transmitted on different frequencies, e.g., between treble and bass frequencies. Another disadvantage of the known construction is that the inner and outer conductors comprise layers of braided wires. The braided wires have freedom of movement with respect to each other, and therefore when the cable is moved, variable contacts between the individual wires may cause additional electrical noise. When the cable is bent or otherwise deformed, the conditions of contact between the individual wires in the braided layers are changed. It is understood that these changes will inevitably change the signal transmission conditions, and hence, the quality of the reproduced sounds. Furthermore, the upper-layer conductor has weak insulation as it is insulated only with a textile braid and optionally with a Teflon tape. This means that the outer-layer conductor may be affected by the external electromagnetic fields and even may not be suitable for some application conditions. Finally, relatively large angles of winding equal to 18 degrees and to 38 degrees for the inner conductor and the outer conductors, respectively, although provide the cable with good flexibility, impair signal transmission conditions. This is because the greater the angle of twisting, the grater is the number of contact points between the individual wires and the greater is a chance of signal distortion.

SUMMARY AND OBJECTS OF THE INVENTION

It is an object of the present invention to provide a coaxial audio cable, which is simple in construction, reliable in operation, efficient in transfer of electrical signals of audible frequencies without the loss of signal power and signal distortions. Another object is to provide an audio cable with groups of wires differentiated and optimized with regard to the frequencies of the transmitted signals. Another object is to provide an audio cable with groups of wires optimized for transmission of electric signals separated by wire groups for reproduction of BASS and TREBLE sounds. Still another object is to provide a coaxial audio cable with wire groups separated for matching the output impedance of the signal amplifiers with the impedance of respective loads. Another object is to provide a cable of the aforementioned type with improved insulation properties against interference with the transmitted signals. Still another object is to provide a dual audio cable with characteristics of individual cables optimized with regard to the impedance of specific loads. Another object is to provide a method for improving efficiency of signal transmission and quality of transmitted signals. Still another object is to provide a method for transmission of signals from a signal amplifier to a load without distortion.

A coaxial audio cable of the invention is designed to separate the audio signal into high and low pitch, e.g., for BASS and TREBLE. This is achieved by using two or more different AWG conductors for inner and outer conductive layers. Furthermore, the inner and outer layers of conductors may have different number of wires and are twisted at different angles to match specific operation conditions of the conductors that fulfill different functions. In addition to insulation layers made from Teflon or a similar plastic, the conductive layers that fulfill different functions can be shielded with a metal foil for additional protection against signal interference. The foil may be placed between the inner layer and the outer layer, and additionally over the outer layers, or only around the outer layer. The conductor wires are insulated from each other by being embedded and sealed in a cured insulating coating such as a curable resin. Another distinguishing feature of the cable of the invention is that the conductor wires are twisted with a relatively low angle, which for the inner layer is within the range from 0 to 18 degrees and for the outer layer is from 8 to 12 degrees. The cable of the invention can be used as a single audio cable or as a dual speaker cable with some difference in the materials and structure of the paired cables. In one specific example, a cable of the invention was made with a polyethylene core covered with an inner conductor, of AWG 21 copper wires twisted around this core with an angle of 5 degrees, an insulating layer of microporous Teflon covering the layer of inner conductors, an outer conductive layer composed of a AWG 22 copper wire twisted at an angle of 10 degrees, a microporous Teflon layer covering the outer conductive layer, and a colored Nylon textile braid coated with a transparent PVC jacket.

DETAILED DESCRIPTION OF THE INVENTION

Figure 1:
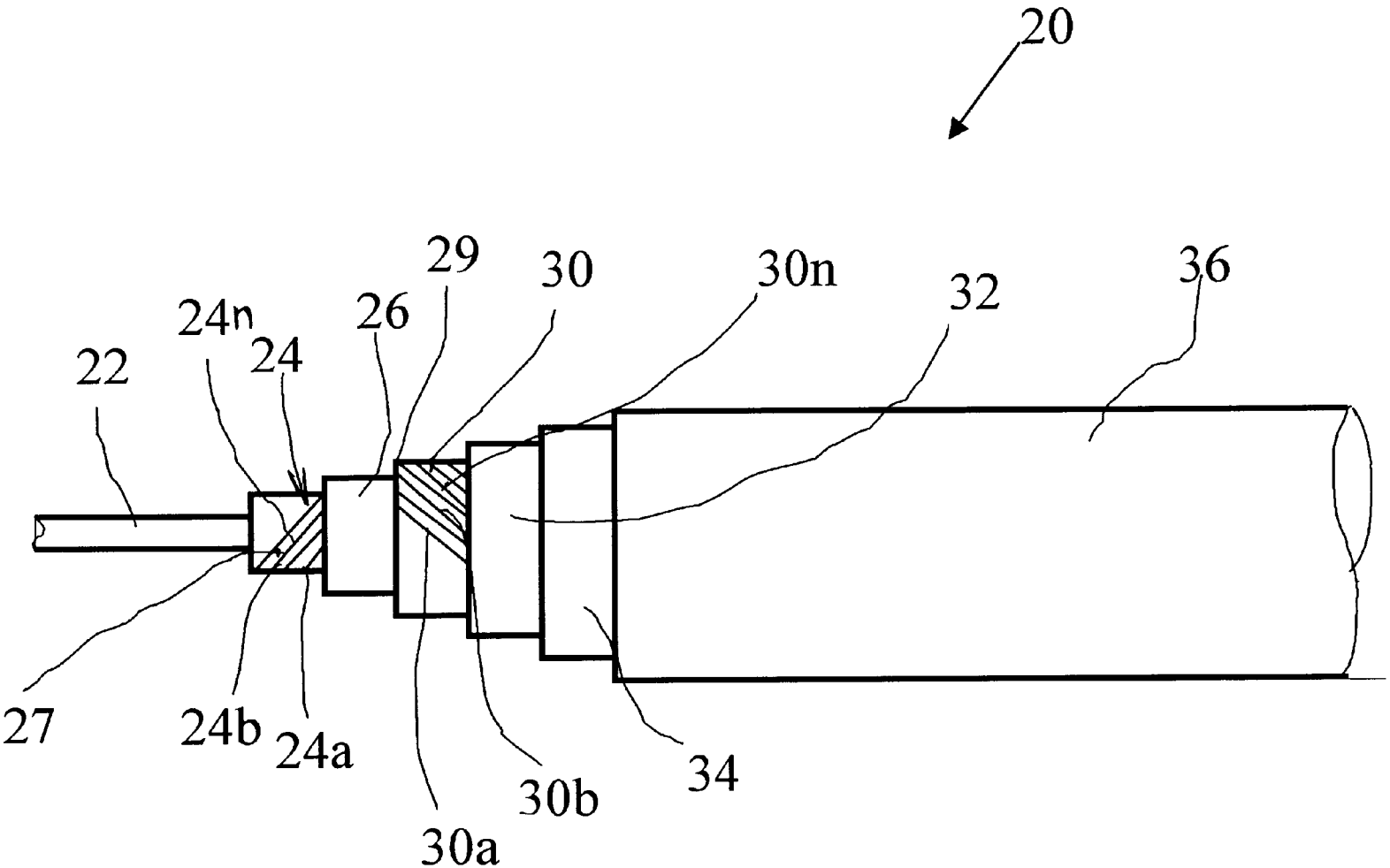
FIG. 1 is a view of the cable made in accordance with one embodiment of the invention with some of the insulation and conductive layers removed for illustration of the cable structure.

An axial audio cable made in accordance with one embodiment of the invention is shown in FIG. 1, which is a view of the cable with some of the insulation and conductive layers removed for illustration of the cable structure. More specifically, as shown in this drawing, the coaxial audio cable 20 has a core 22 of a non-conductive material, e.g., polyethylene, covered with a layer of inner conductors 24. The layer 24 may be composed of a plurality (at least two) of conductive wires 24*a*, 24*b*, 0.005"~and higher 24*n* of a certain diameter, e.g., of AWG 21 copper wires twisted around the core 22 with a twist angle from 0 to 18 degrees. It has been found that the optimum angle is about 5 degrees. This angle is measured relative to the axial direction of the cable. The wires 24*a*, 24*b*, 0.005"24*n* that form the inner conductor are insulated from each other by being polymer-coating 27, e.g. The inner conductive layer 24 is coated with a first insulation layer 26 of a non-conductive material, e.g., microporous Teflon that may have a thickness from 0.010" and higher. The inner conductive layer 24 together with the insulation coating 26 may have a thickness from 0.010" and higher.

Figure 2:
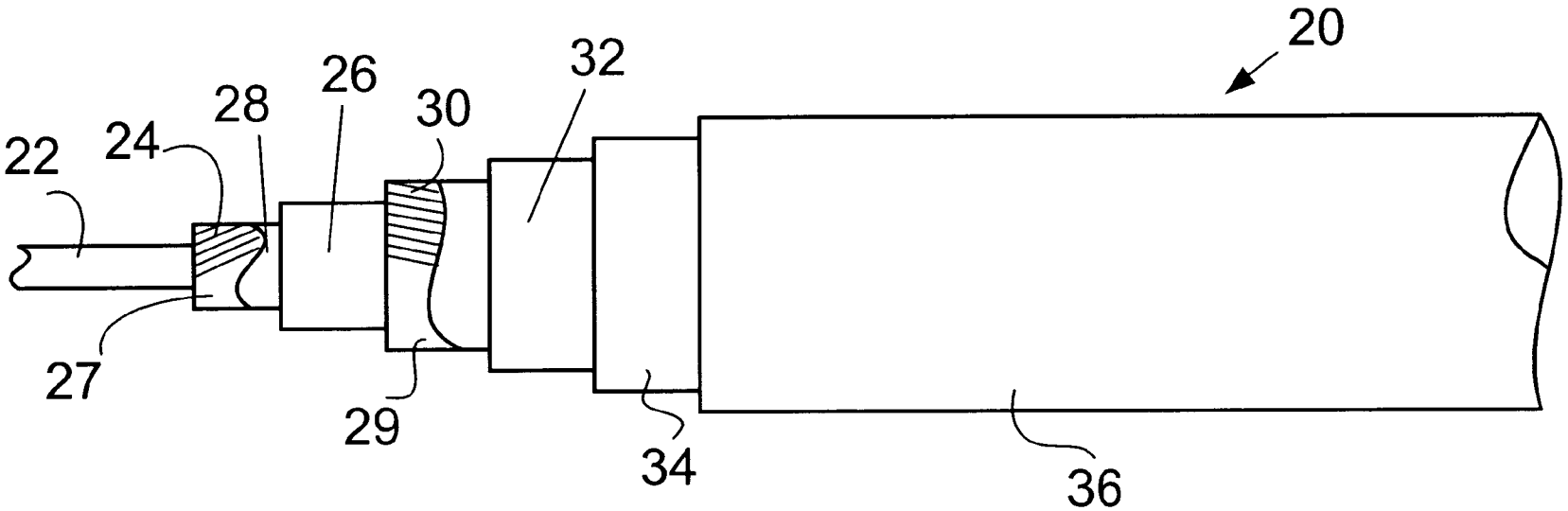
FIG. 2 is a view similar to FIG. 1 illustrating a cable with foil shields.

If necessary, a foil shield 28, e.g., of 0.002 shown in FIG. 2, can be placed between the inner conductive layer 24 and the insulation coating 26. This would impart to the cable additional shielding against interference between the inner layer 24 and an outer conductive layer 30, which is twisted over the insulation coating 26 with a twist angle different from the one used in the inner conductive layer. The layer 30 may be composed of a plurality of conductive wires 30*a*, 30*b*, 0.008" 30*n* of a certain diameter, e.g., of AWG 22 copper wires twisted around the core 22 with a twist angle from 8 to 12 degrees. It has been found the twist angle of 10 degrees is the most suitable. This angle is measured relative to the axial direction of the cable. The wires 30*a*, 30*b*, 0.008" 30*n* that form the outer layer 30 are insulated from each other by being by being polymer-coating 29, e.g The outer conductive layer 30 is coated with a second insulation layer 32 of a non-conductive material, e.g., microporous Teflon that may have a thickness from 0.010" and higher. The outer conductive layer 30 together with the insulation coating 32 may have a thickness from 0.010" and higher.

The insulation coating 32 is coated with an additional protective insulation layer 34 made, e.g., of a colored Nylon textile braid coated with a protective transparent PVC jacket 36. This jacket may have a thickness from 0.045" and higher.

Although the inner and outer conductive layers may have conductors of different diameters and angles of twisting, they should both have the same matched impedance to deliver efficient transfer of balanced audio signals.

Figure 3:
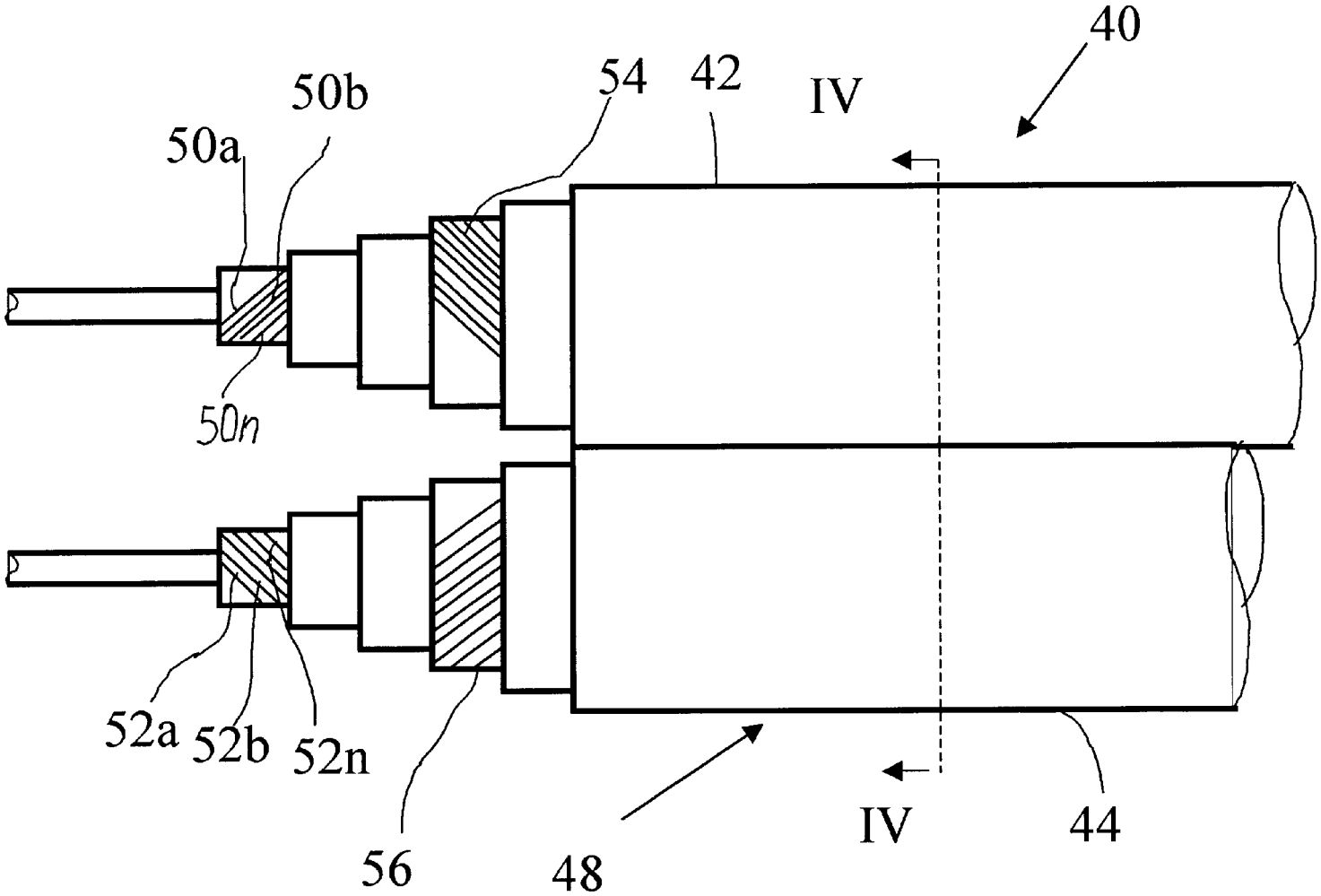
FIG. 3 is a view similar to FIG. 1 but illustrating two parallel cables of the invention.
Figure 4:
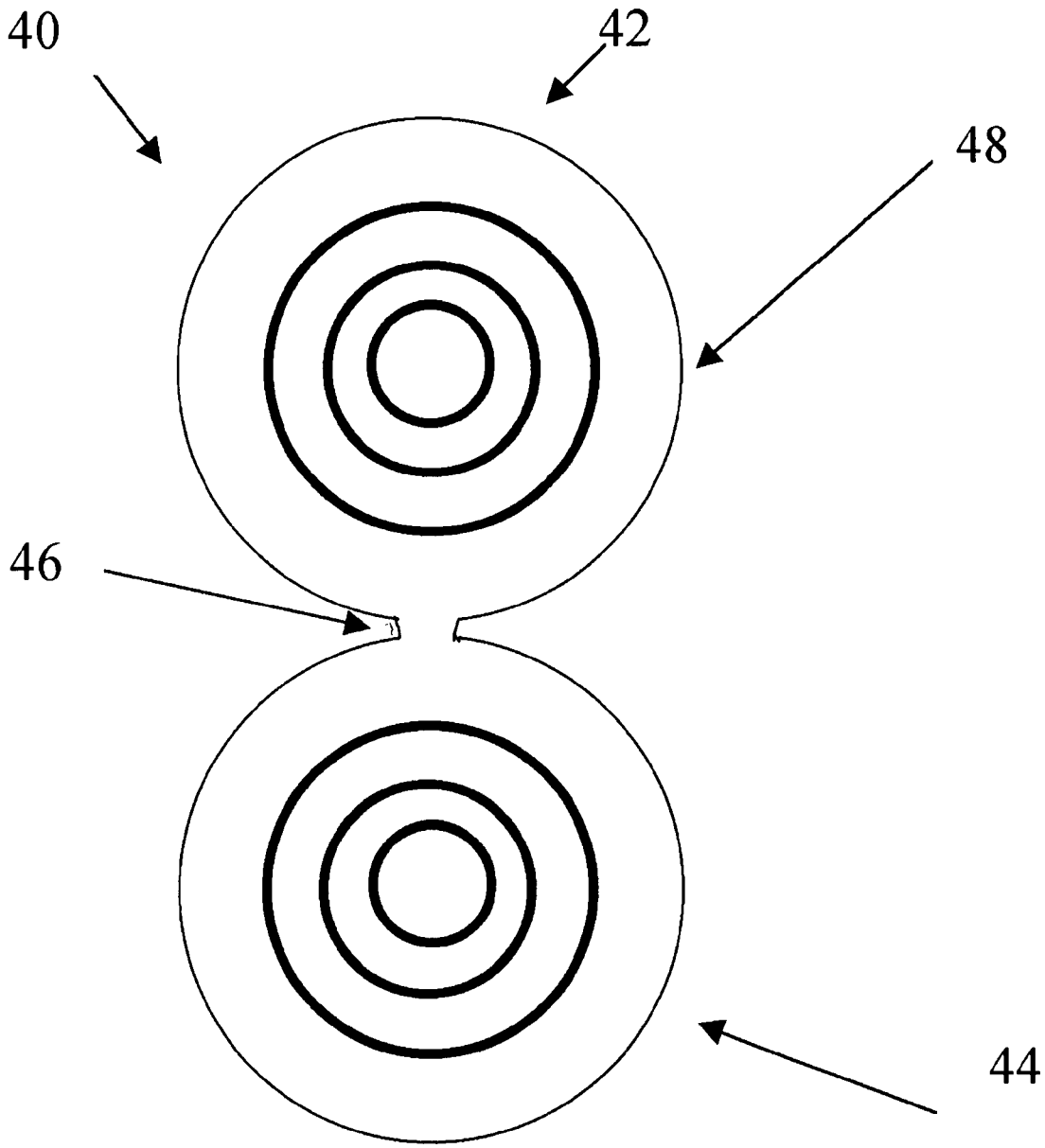
FIG. 4 is a cross-sectional view of the dual cable assembly of FIG. 3 along the line IV—IV of FIG. 3.

According to another embodiment shown in FIGS. 3 and 4, two cables of the type described in the previous embodiment can be assembled into a dual cable structure. FIG. 3 is a view similar to FIG. 1 but illustrating two parallel cables of the invention, and FIG. 4 is a cross-sectional view of the dual cable assembly of FIG. 3 along the line IV—IV of FIG. 3. Such an arrangement is suitable for transferring electric signals to two different loads, e.g., to speakers with different input impedances.

As can be seen from FIGS. 3 and 4, the cable assembly 40 consists of two coaxial audio cables 42 and 44, which are integrally connected by a bridge portion 46 of a single protective insulation jacket 48, made, e.g., of transparent polyvinyl chloride (PVC).

In general, both cables have the same construction of the type shown and described with reference to the embodiments of FIGS. 1 and 2. The components of the individual cables 42 and 44 may have the same dimensions and parameters. If necessary, e.g., for transferring signals to different loads, the components of the cables 42 and 44 may have diameters of the wires 50*a*, 50*b*, 0.091" 50*n* different from those of the wires 52*a*, 52*b*, 0.136" 52*n*. The same relates to the wires in the outer conductive layers 54 and 56. Similarly, the wires of the cables 42 and 44 may have other different parameters, such as angles of twisting and thickness of insulation layers. This may be required for matching the impedances of the specific cables with the impedances of the loads to which these groups of wires transmit the signals.

Thus, it has been shown that the present invention provides a coaxial audio cable, which is simple in construction, reliable in operation, efficient in transfer of electrical signals of audible frequencies without loss of signal power and signal distortions, has groups of wires differentiated and optimized with regard to the frequencies of the transmitted signals, e.g., for reproduction of BASS and TREBLE sounds, and for matching the output impedance of the signal amplifier with the impedance of respective loads. The cables possess improved insulation properties against interference with the transmitted signals. The invention also provides a dual audio cable with characteristics of individual cables optimized with regard to the impedances of specific loads. The first conductive layer and the second conductive layer are characterized by impedances different for the same frequency of electrical signal transmitted through the cable.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the number of concentric conductive layers may exceed two with grouping the signals into more than two frequency ranges. In other words, in this case, each conductive layer will correspond to a specific range of the frequency spectrum of the transmitted electrical signals. Each additional conductive layer can be shielded with an individual foil shield, or the foil shields can be used for selected layers. The layers may differ in the diameter of wires, twisting angle, wire materials, etc. Insulation layers may be formed from materials different from those mentioned in the description. The cables may be used for transmission of video signals, or for signals of other frequency ranges. Although the invention has been described with reference to a coaxial cable having a non-conductive core, it is understood that the principle of the present invention is applicable to coaxial cables having a conductive core, which is isolated from the first concentric conductive layer by an insulating layer, while the rest is the same.

What is claimed is:

1. A coaxial audio cable assembly for transmitting electrical audio signals from a signal source to a load comprising at least one coaxial audio cable, said at least one coaxial cable comprising:

a core of a non-conductive material having a longitudinal axis;

an inner conductive layer composed of a plurality of conductors twisted with a twist angle from 0 to 18 degrees with respect to the direction of said longitudinal axis and mutually isolated by being embedded in an electrical insulation material;

a first insulation layer of a non-conductive material coating said inner conductive layer;

an outer conductive layer composed of a plurality of conductors twisted with a twist angle from 8 to 12 degrees with respect to the direction of said longitudinal axis and mutually isolated by being embedded in an electrical insulation material;

a second insulation layer of a non-conductive material coating said outer conductive layer;

an additional protective insulation layer coating said second insulation layer; and a protective jacket coating said additional protective insulation layer;

said inner conductive layer and said outer conductive layer being characterized by impedances different for the same frequency of electrical signals transmitted from said signal source to said load;

said core of a non-conductive material being polyethylene, said first insulation layer and said second insulation layer being made from microporous Teflon, said additional protective insulation layer being made from a textile Nylon braid, and said protective jacket being made from polyvinyl chloride.

* * * * *